US009522804B1

(12) United States Patent
Hill

(10) Patent No.: US 9,522,804 B1
(45) Date of Patent: Dec. 20, 2016

(54) CABLE DISPENSER

(71) Applicant: Douglas C. Hill, Brook Park, OH (US)

(72) Inventor: Douglas C. Hill, Brook Park, OH (US)

( * ) Notice: Subject to any disclaimer, the term of this patent is extended or adjusted under 35 U.S.C. 154(b) by 168 days.

(21) Appl. No.: 14/560,925

(22) Filed: Dec. 4, 2014

Related U.S. Application Data

(60) Provisional application No. 62/043,800, filed on Aug. 29, 2014.

(51) Int. Cl.
*B65H 49/28* (2006.01)
*B65H 75/40* (2006.01)
*B65H 49/32* (2006.01)

(52) U.S. Cl.
CPC ..... *B65H 75/403* (2013.01); *B65H 49/325* (2013.01); *B65H 2301/3251* (2013.01)

(58) Field of Classification Search
CPC ..... B65H 49/28; B65H 75/403; B65H 2301/3251
See application file for complete search history.

(56) References Cited

U.S. PATENT DOCUMENTS 1,518,749 A * 12/1924 Nelson ..... B65H 35/0006 225/67
3,815,842 A * 6/1974 Scrogin ..... H02G 11/02 242/423.1
3,937,414 A * 2/1976 Bank ..... B65H 49/38 242/129
4,184,647 A * 1/1980 Rourke ..... B21C 47/18 242/129.8
5,189,719 A 2/1993 Coleman et al.
6,486,395 B1 11/2002 Temblador
RE38,345 E 12/2003 Falciglia et al.
6,825,418 B1 11/2004 Dollins et al.
7,456,361 B2 11/2008 Hill
7,608,782 B2 10/2009 Hill

OTHER PUBLICATIONS

Hill, Douglas C.; U.S. Appl. No. 12/572,283 for "Clip," filed Oct. 2, 2009.
Hill, Douglas C.; U.S. Appl. No. 60/688,954 for "Clip," filed Jun. 9, 2005.
Hill, Douglas C.; U.S. Appl. No. 60/759,715 for "Clip for flexible armored cable," filed Jan. 18, 2006.

* cited by examiner

*Primary Examiner* — Sang Kim
(74) *Attorney, Agent, or Firm* — Rankin, Hill & Clark LLP

(57) ABSTRACT

A cable dispenser for unwinding a cable from a purchased spool of cable wherein the cable dispenser includes a base plate formed from a rigid sheet of material has a top side and a bottom side, the top side having at least one vertically extending hub shaped to receive a central opening in a spool of cable and the base plate further including at least one alignment peg to help orient the central opening of the spool onto the at least one hub.

21 Claims, 6 Drawing Sheets

CABLE DISPENSER

This application claims priority to provisional patent application Ser. No. 62/043,800 filed on Aug. 29, 2014, which is incorporated by reference herein.

The invention of this application relates to cable dispensers and, more particularly, to a new cable dispenser that can be used to unwind cable from a purchased cable spool that includes a central core.

The invention of this application relates to cable dispensers and, more particularly, to a new cable dispenser that can be used to unwind cable from up one or more purchased cable spools having a central core.

The dispenser of this application has been found to work well in the construction industry and for the unwinding of large spools of cable; accordingly, it will be disclosed in direct relation to this industry and the large spools. However, the invention of this application has broader application and could be used in other industries and for other cables, wires and/or conduits wherein it should not be limited to the disclosed use.

INCORPORATION BY REFERENCE

The present invention relates to conduits used for electrical wiring and, more particularly, for cables used for electrical wiring and the unwinding of the spools of these cables that are purchased for the building and/or construction industry. Coleman et al U.S. Pat. No. 5,189,719 discloses a rectangular flexible armored cable; Falciglia et al RE 38,345 discloses a round flexible armored cable; and Dollins et al. U.S. Pat. No. 6,825,418 discloses a coded flexible armored cable. These patents are incorporated by reference herein as background information illustrating flexible armored cables including MC style cables and form part of this specification. Temblador U.S. Pat. No. 6,486,395 discloses a flexible armored cable with a special wiring configuration to illustrate that the invention of this application can be used in connection with all flexible armored cable, regardless of the wire gauge and/or wire configuration in the flexible armored cable, and is also incorporated by reference herein as background information and forms part of this specification. This application also incorporates by reference U.S. patent application Ser. No. 12/572,283 filed on Oct. 2, 2009 which is a continuation of U.S. application Ser. No. 12/069,780, filed Feb. 13, 2008 (now U.S. Pat. No. 7,608,782 issuing on Oct. 27, 2009), which application is a continuation-in-part of U.S. patent application Ser. No. 11/450,119 filed on Jun. 9, 2006 (now U.S. Pat. No. 7,456,361 issuing on Nov. 25, 2008) which application claims priority in U.S. provisional application Ser. No. 60/688,954, filed Jun. 9, 2005, entitled "CLIP" and U.S. provisional application Ser. No. 60/759,715, filed Jan. 18, 2006, all of which are incorporated by reference herein and form part of this specification.

SUMMARY OF INVENTION

The invention of this application relates to a cable dispenser and, more particularly, to a cable dispenser that can be used to dispense cable from a purchased spool of cable without kinking.

More particularly, the invention of this application relates to a cable dispenser for unwinding a cable from a purchased spool of cable. The cable dispenser including a base plate formed from a rigid sheet of material. The base plate having at least one vertically extending hub shaped to receive the central opening in a spool of cable. The base plate further including at least one alignment pegs to help orient the central opening of the spool onto the at least one hub.

According to other aspects of the invention, the base plate includes a top side that has the at least one hub and a bottom side. The bottom side can include a plurality of casters to allow the cable dispenser to move on an underlying surface to allow the cable dispenser to be re-positioned at a job site.

According to a further aspect of the invention, the base plate can include one or more handles to allow the cable dispenser to be transported and/or repositioned.

According to yet other aspects of the invention, the base plate includes a bearing assembly for each of the at least one hubs to allow for the free rotation of the spool on the cable dispenser. This works in combination with the hub to allow for the controlled rotation of the spool about a vertical spool axis thereby preventing kinking as the cable is dispensed.

According to one set of embodiments, the bearing assembly includes a plurality of individual ball rotation bearings circumferentially spaced about the hub. While not required, it is preferred that there are four ball rotation bearings.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
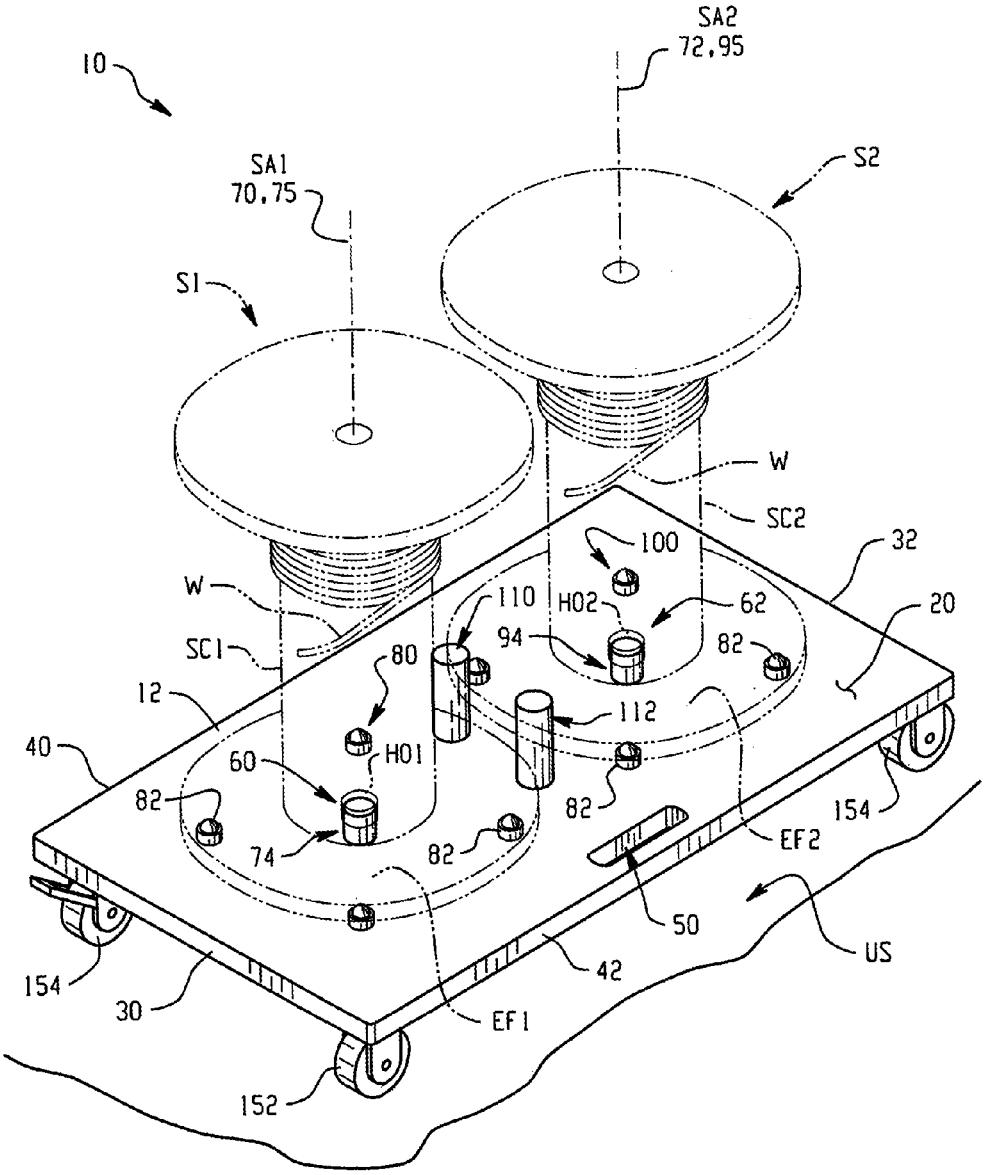
FIG. 1 is a top perspective view of a cable dispenser according to certain aspects of the invention of this application.
Figure 2:
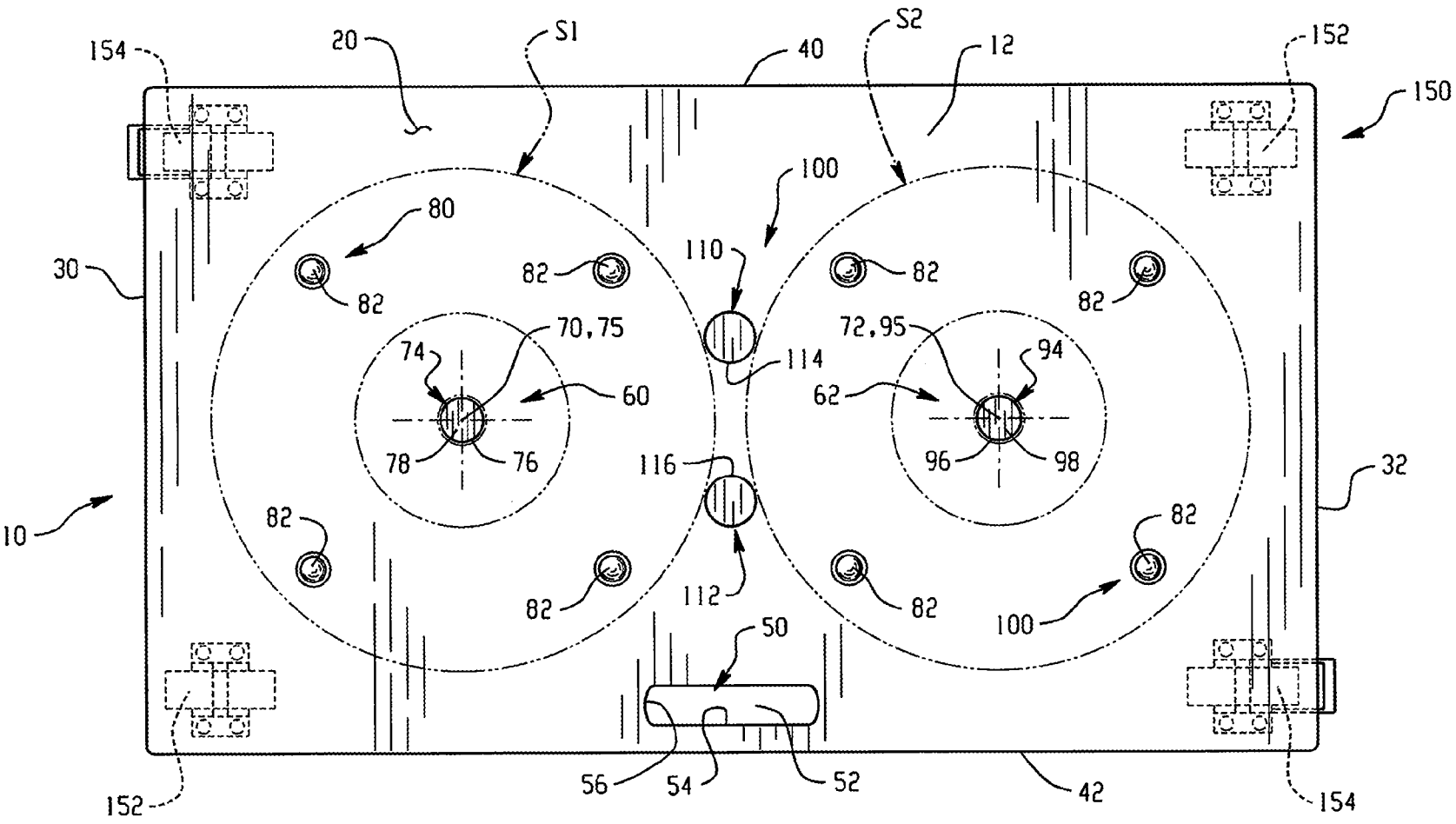
FIG. 2 is a top side view of the cable dispensing shown in FIG. 1.
Figure 3:
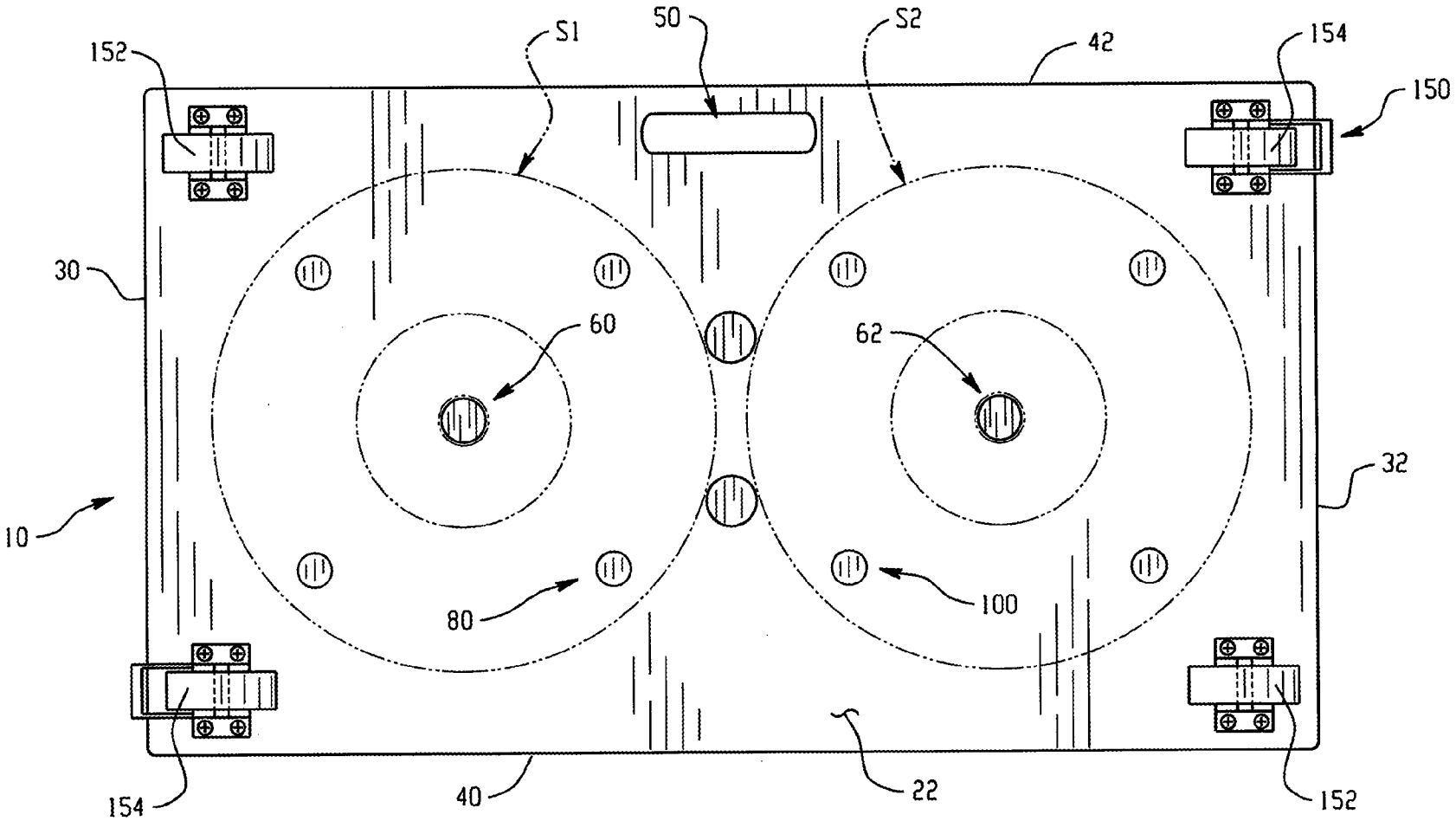
FIG. 3 is a bottom side view of the cable dispensing shown in FIG. 1.
Figure 4:
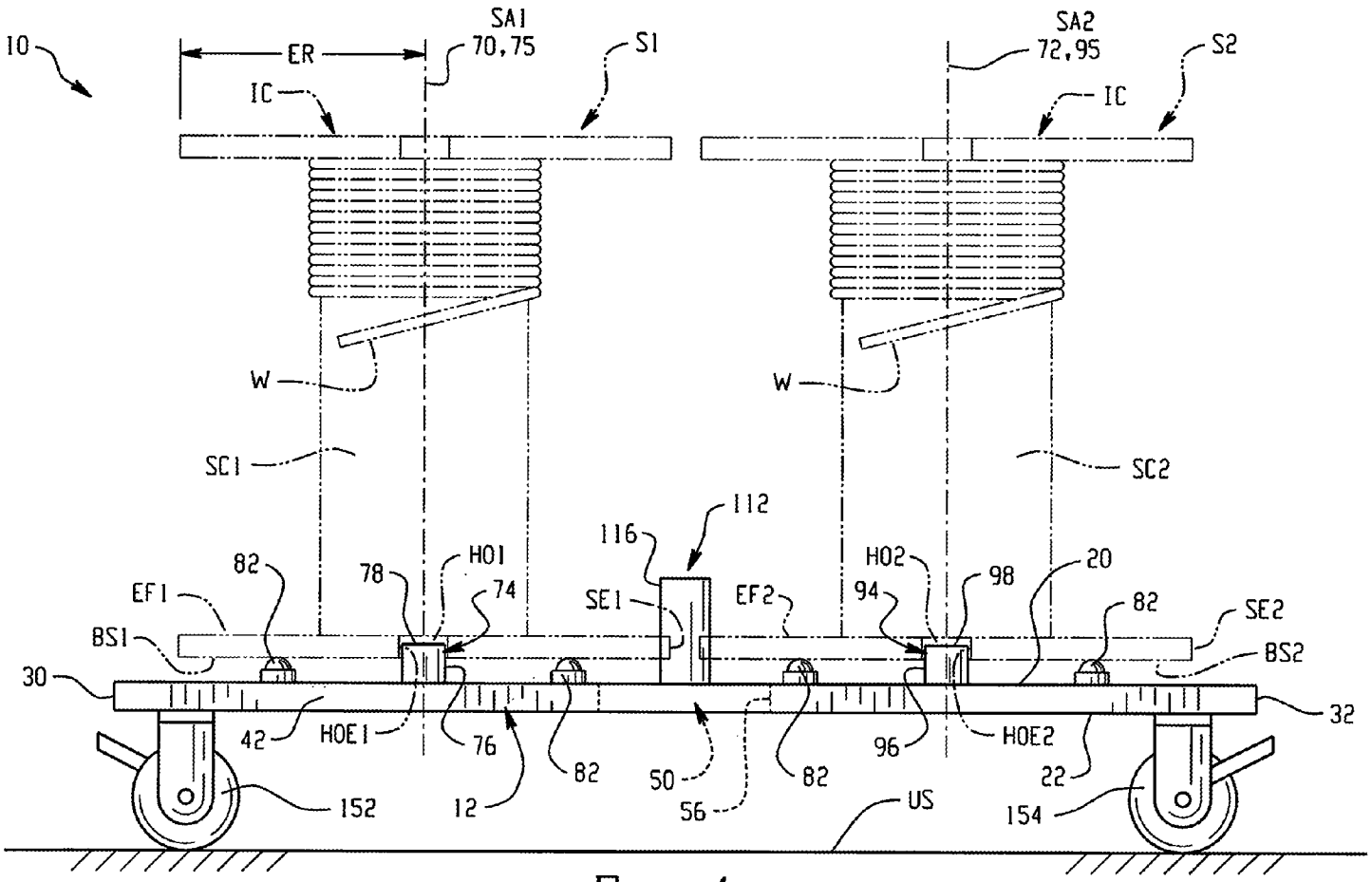
FIG. 4 is a side edge view of the cable dispensing shown in FIG. 1.
Figure 5:
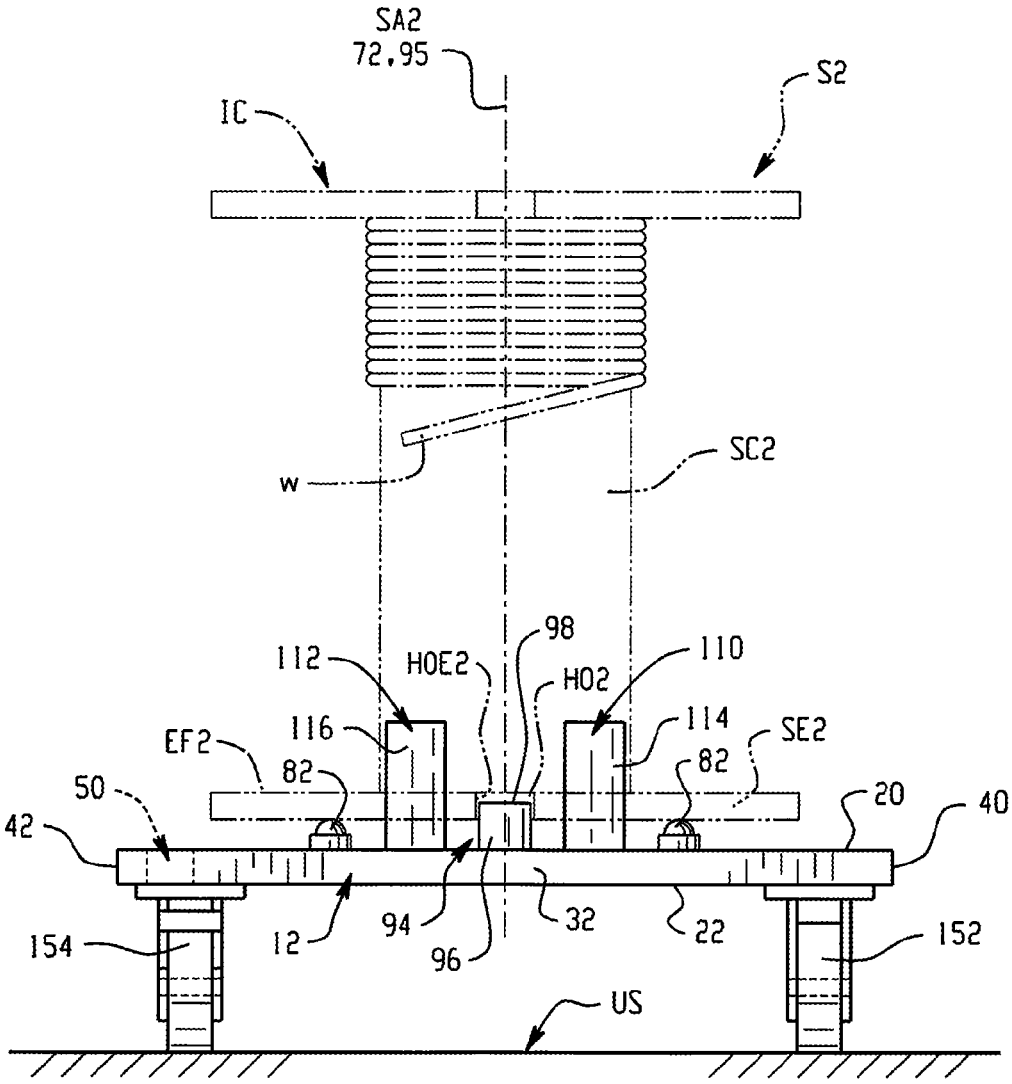
FIG. 5 is an end edge view of the cable dispensing shown in FIG. 1; and, FIG. 6 is a top side view of yet other sets of embodiments of the invention of this application.

Referring now to the drawings wherein the showings are for the purpose of illustrating preferred and alternative embodiments of the invention only and not for the purpose of limiting the same, FIGS. 1-5 show a cable dispenser 10 for dispensing one or more spools of cable S. In a preferred set of embodiments, the cable dispenser is configured to support two spools S1 and S2 wherein the invention will be disclosed in connection with two spools. However, the invention should not be limited to this example arrangement.

More particularly, dispenser 10 is formed by a base plate 12 having a top surface or side 20 and a bottom surface or side 22. Base plate 12 further includes end edge 30 and 32 along with side edges 40 and 42 that can be configured to join the end edges. As is shown, a disclosed set of embodiments of this application includes parallel edges wherein base plate 12 has a generally rectangular configuration, but this is not required.

Base plate 12 can be designed based on the weight of the spools to be supported. This can include plates made from a wide range of materials including, but not limited to, steel, aluminum, alloys, wood and polymers. Further, depending on materials, weights and material thicknesses, base plate 12 can further include structural reinforcements including, but not limited to ribs, framed edges, trusses, beams, rails and the like. Further, multiple materials could be utilized. This can include, but is not limited to, base plate 12 having multiple layers. Yet further, these multiple layers could have different properties wherein an inner layer could be an inner structural layer and have one or more outer layers can be protective and/or cosmetic layer(s). The multiple materials could also include a sheet component of one material and one or more structural reinforcements formed from different materials. Yet even further, base plate, including the structural reinforcements, could be a single unitary component or made from more than one structural component.

Cable dispenser 10 can further include one or more carrying handles 50 that can be configured to transport dispenser 10 to the job site and/or within the job site. As is shown, cable dispenser 10 includes a single handle 50 that is a transport handle. Handle 50 can be formed by an elongated opening 52 in base plate 12 and is configured to allow for easy transport of dispenser 10. Further, elongated opening 52 can be sized and shaped to allow a wide range of hand sizes, with or without gloves, to grab and carry dispenser 10 wherein opening 52 can have parallel sides 54 and curved ends 56. While not shown, handle 50 could also be a separate component fastened relative to base plate 12 and/or other structural components of dispenser 10 and/or an additional component attached to elongated opening 52 to make the opening wider and/or cushioned. As will be discussed more below with respect to other embodiments, dispenser 10 can further include one or more positioning handle that allow cable dispenser 10 to be easily moved when in use to help position the dispenser. While not shown in the example embodiments, device 10 can include both types of handles and/or other mechanisms to help in the transportation and/or positioning of the device.

Dispenser 10 is configured to support one or more spools of wire or cable S. For illustration only, the figures of this application show examples of spools S that can be utilized with the invention of this application. However, while a particular spool configuration is shown, the invention of this application should not be limited to this example wherein spool S can be a wide range of spools known in the art. In greater detail, spools S include an inner core assembly IC formed by a spool core SC and end flanges EF wherein spools S support a length of wire W. While not shown in the interest of brevity, the spools can include a wide range of other features, such as metal internal structural rods, without detracting from the invention of this application. Spools S further include hub openings HO in end flange EF to allow the spool to be rotated about a spool axis SA. Hub openings HO include at least one hub opening edge HOE that can be a single cylindrical edge coaxial with spool axis SA. Spool S further includes a bottom surface BS that will be discussed more below. End flange EF is generally circular thereby having an end flange radius ER from spools axis SA. In that the invention of this application can support multiple spools, the figures in this application show both a first spool S1 and a second spool S2 wherein the elements above will be designated with a "1" or "2" suffix if relating to a particular spool.

Dispenser 10 includes at least one spool support station configured to support the desired spool. In the embodiments shown, dispenser 10 includes a first support station 60 to support spool S1 and a second support station 62 to support spool S2. Support station 60 supports spool S1 such that spool S1 is rotatable about a first station axis 70. And, station axis is generally coaxial with spool axis SA1. Similarly, Support station 62 supports spool S2 such that spool S2 is rotatable about a second station axis 72, which is generally coaxial with spool axis SA1 and which will be discussed more below.

More particularly, first support station 60 includes a first hub 74 shaped to receive and rotatably support a hub opening HO1 in spool S1. Hub 74 includes a circumferential hub edge 76 and a distal end 78. Hub edge generally defining a hub axis 75 that is coaxial with station axis 70 Circumferential hub edge 76 is sized to at least partially penetrate hub opening HO1 for the rotatable support of spool S1. In the embodiment shown, hub support station 60 further includes a bearing assembly or arrangement 80 that allows for the free rotation of spool S1 about station axis 70. In the embodiments shown, bearing arrangement 80 includes a plurality of roller ball bearings 82 that are circumferentially spaced about first station axis 70. The plurality of roller ball bearings can be at least three roller bearings 82. As is shown, station 60 includes a four roller ball bearings arrangement that extends circumferentially about station axis 70. Roller ball bearings 82 can be any roller ball bearings and/or bearing arrangement known in the industry that can support the weight of spool S1. While not required, roller ball bearings 82 can be spaced equidistant from station axis 70. Yet further, bearing assembly or arrangement 80 could be one or more unified annular rings of bearings (not shown), roller bearings and/or any other bearing arrangement known in the art to rotationally support the spool. Bearings 82 engage spool bottom surface BS1 to support the weight of spool S1 and allow rotation about axes SA1, 70.

Similarly, support station 62 can support spool S2 such that it is rotatable about second station axis 72. Support station 62 includes a second hub 94 shaped to receive a hub opening HO2 in spool S2. Hub 94 includes a circumferential edge 96 and a distal end 98. Hub edge 96 generally defining a hub axis 95 that is coaxial with station axis 72. Circumferential hub edge 96 is sized to at least partially penetrate hub opening HO2 for the rotatable support of spool S2. In the embodiments shown, hub support station 62 further includes a bearing arrangement 100 that allows for the free rotation of spool S2 about station axis 72 such that station axis 72 is generally coaxial with spool axis SA2. Bearing arrangement 100 can also include roller ball bearings 82 that are circumferentially spaced about second station axis 72. Again, the plurality of roller ball bearings 82 can be at least three units. As is shown, four roller ball bearings are utilized about station axis 72. While not required, roller ball bearings 82 can be spaced equidistant from station axis 72. Bearings 82 engage spool bottom surface BS2 to support the weight of spool S2 and allow free rotation about axes SA2, 72. The hubs discloses in this application can have a wide range of configuration without detracting from the invention of this application. Thus, while these "hubs" are shown as being cylindrical, the term "hub" is not to be limited to cylindrical hubs. In this respect, the "hubs" could be any shape utilized to engage with the hub opening and allow relative rotation of the spool relative to the dispenser. This can include, but is not limited to, devices with cylindrical shapes, oval shapes, polygonal shapes, elongated configurations, cut outs, plates, curved plates, plate recesses, and the like.

Dispenser 10 further includes one or more alignment mechanism 100. The alignment mechanisms can be individual mechanisms for each station as will be discussed more below or joint mechanisms for both stations as is shown in connection with dispenser 10. In greater detail, alignment mechanism 100 can be configured to be engageable with spool edge SE to help direct hub opening HO onto hubs 74 or 94. Any mechanical alignment shape could be used to direct the hub into the hub openings.

Dispenser 10 includes alignment pegs 110 and 112 that include edges 114 and 116, respectively, which are configured to engage side edge SE1 and SE2 to direct the hub into the hub opening. The pegs disclosed and claimed in this application can have a wide range of shapes without detracting from the invention of this application. Thus, while these "pegs" are shown as being cylindrical, the term "peg" is not to be limited to cylindrical pegs. In this respect, the "pegs" could be any shape utilized to help align the bottom flange of the spool onto the hub. This can include, but is not limited to, devices with cylindrical shapes, oval shapes, polygonal shapes, elongated configurations, cut outs, plates, curved plates, plate recesses, and the like.

Once the hub is seated in hub opening, pegs 110 and 112 can be configured to be spaced from edge SE to allow the free rotation of the spool on dispenser 10. In this configuration, pegs 110 and 112 are spaced from hub 74 such that edges 114 and 116 of the pegs are generally spaced from station axis 70 by the end flange radius ER. Therefore, the alignment mechanisms are configured to closely position the spool about the appropriate spool axis, but not exactly. In another set of embodiments, pegs 110 and/or 112 can be configured to engage edge SE to create functional resistance to provide more controlled unwinding of the wire from the spool and prevent free rotation. While it is contemplated that these pegs (or other shaped alignment mechanisms) could be used for rotation control, other independent mechanisms could be used for functional resistance without detracting from the invention of this application. As is shown in this set of embodiments, pegs 110 and 112 are the alignment mechanism for both support stations 60 and 62. This can be achieved based on the spacing between hubs 74 and 94 along with the diameter of edges 114 and 116. While only two pegs are shown, more or less pegs could be used without detracting from the invention of this application. But, it is preferred that at least two pegs be utilized for a station.

Dispenser 10 can further include motion devices 150 to allow the dispenser to move across an underlying surface US. Further, in a preferred set of embodiments, movement device are configured to allow for selective movement wherein dispenser 10 can be allowed to move and/or be prevented from movement from a desired location. Motion devices can include any motion devices known in the industry including, but not limited to, casters, swivel casters, locking casters, ball bearing slides, wheels, rollers and/or glides, and the like. As is shown, dispenser 10 includes a plurality of casters 152 and 154 spaced about bottom surface or side 22. In a preferred set of embodiments, casters 152 are two swivel casters and caster 154 are two locking swivel casters. This arrangement allows for the easy and unlimited movement of dispenser 10 about an underlying surface US with minimal resistance. Then, locking casters 154 can be locked when in a desired position or location to prevent unwanted movement. The locking casters can then be unlocked to allow for subsequent movement.

In operation, spool S1 is positioned over station 60 and alignment pegs 110 and 112 are used to guide hub opening HO1 into alignment with hub 74. Once in alignment, hub 74 will enter hub opening HO1 and spool end flange EF1 will drop onto bearing arrangement 80 wherein one or more of bearings 82 will engage spool bottom surface BS1. In that hub opening HO1 is over hub 74, spool S1 will be allowed to freely and controllably rotate about station axis 70; partly based on hub 74 and partly based on bearings 82. Once in this position, the end user can merely pull on cable or wire W to unwind wire W from spool S1. Similarly, spool S2 can be positioned over station 62 and alignment pegs 110 and 112 can be used to guide hub opening HO2 onto hub 94. Once in alignment, hub 94 will enter hub opening HO2 and spool end flange EF2 will drop onto bearing arrangement 100 wherein one or more of bearings 82 will engage bottom surface BS2 of spool end flange EF2. In that hub opening is over hub 94, spool S2 will be allowed to freely and controllably rotate about station axis 72; partly based on hub 94 and partly based on bearings 82. Once in this position, the end user can also pull on the cable or wire to unwind the cable or wire from spool S2. Spool S1 and S2 can have the same wire to allow for a greater supply of wire or can include different wire to allow the end user to work with different wires with a single dispenser.

In that the spools are allowed to freely rotate about axes 70 and 72, the cable or wire can be removed from the dispenser without unwanted kinks. This allows a single user to unwind the cable from the coil and this can be done while on a ladder or scaffolding without the need for assistance by other workers or working the kinks out of the cable. In that the dispenser includes locking casters, the dispenser can be maintained in a desired location even when the wire is being pulled. If the dispenser needs to be repositioned, the locking casters can be unlock and the entire devices can be move freely about the job site.

Figure 6:
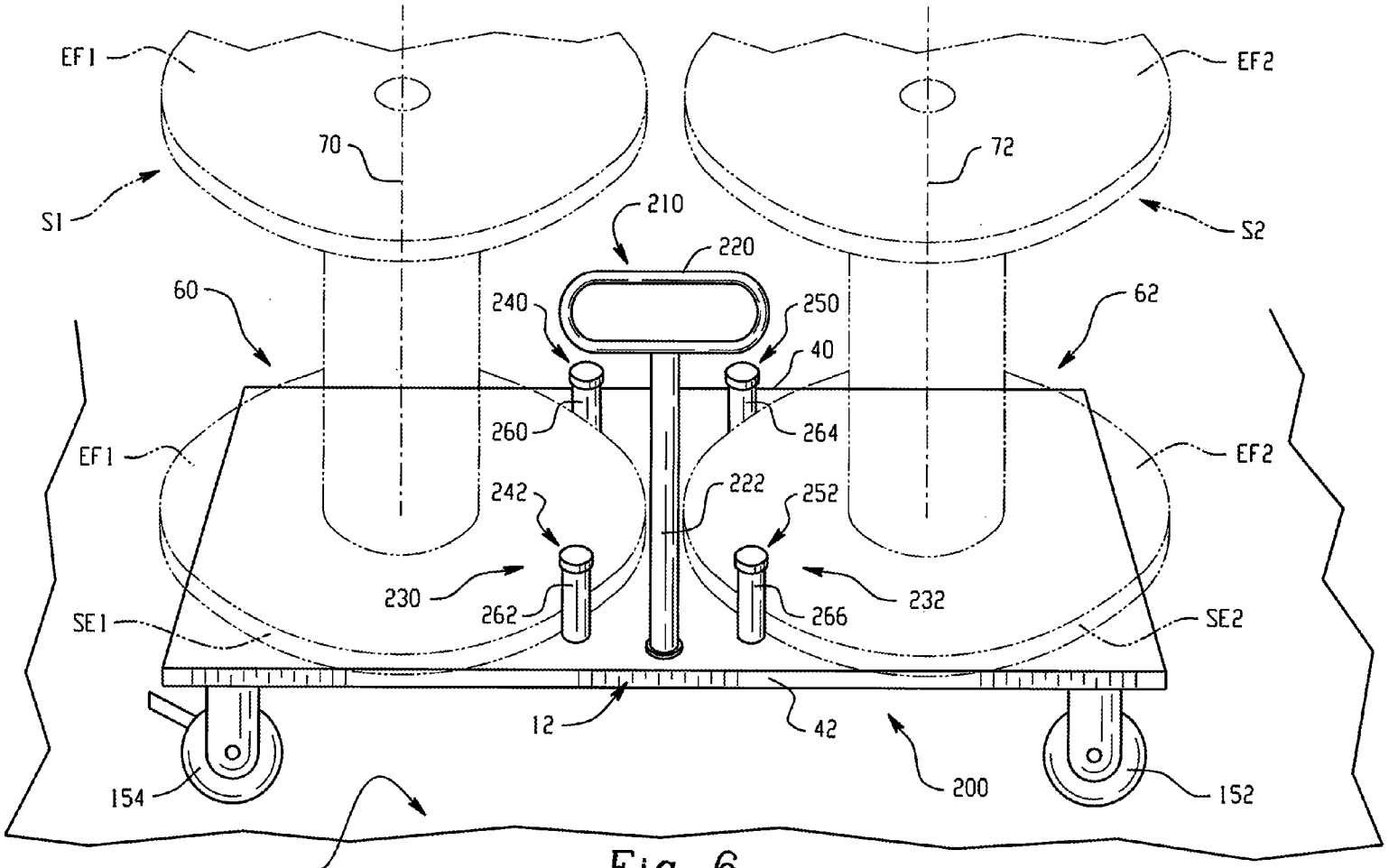

With reference to FIG. 6, shown is a dispenser 200 that includes alternative embodiments of the invention of this application. In the interest of brevity, like structure will be shown with like reference numbers and will not be repeated with respect to dispenser 200. In this respect, dispenser 200 can include any of the features and/or structures discussed above without detracting from this set of embodiments.

In addition to above, dispenser 200 includes one or more positioning handles 210 that aid in the movement of the dispenser after the spools are in an operating position to allow the cable dispenser to be easily moved about surface US without bending over. While the end user could use the spools to move the dispenser, the spools can rotate, which can reduce the effectiveness. Handle 210 can include a hand grip 220 and a grip extension 222 so that hand grip is at a usable height above surface US. Handle 210 can be in replacement of handle 50 or in combination with handle 50 to allow for both transport and positioning of the dispenser. In this respect, according to one set of embodiments, handle 210 can be selectively removable, re-positionable and/or configured to fold flat against top surface 20. This particular arrangement can help for storage of the device and/or could be used to carry the dispenser.

However, dispenser 200 shows an alternative design for the alignment of the spools into the spool support stations. In this respect, spool 200 includes individual alignment mechanisms 230 and 232 wherein mechanism 230 is for station 60 and mechanism 232 is for station 62. In greater detail, mechanism 230 includes pegs 240 and 242 for station 60 and mechanism 232 includes pegs 250 and 252 for station 62. As with the embodiments discussed above, the pegs can include one or more side edges to engage the side edges SE1 or SE2. In this respect, peg 240 includes an edge 260, peg 242 includes an edge 262, peg 250 includes an edge 264 and peg 252 includes an edge 266. However, edges 260 and 262 are configured to engage only side edge SE1 and edges 264 and 266 are configured to engage only side edge SE2 to direct the respective hubs into the respective hub openings. While functionally, these are the same as the alignment mechanisms discussed above, they are separated to work in connection with only one station.

Yet further, any of the alignment mechanisms of this application can also be adjustable to allow for the dispenser to work in connection with differently size spools of wire. This can include, but is not limited to, different openings in base plate 12 to allow movement of the pegs, cam shaped pegs that can be rotated, mounting the pegs in a slot, providing multiple pegs having different shapes or diameter, or the like.

Again, while not shown in the figures of this application, device 10 and/or 200 could include both types of handles and/or other mechanisms to help in the transportation and/or positioning of the device and/or a combination alignment device.

While considerable emphasis has been placed on the preferred embodiments of the invention illustrated and described herein, it will be appreciated that other embodiments and/or equivalents thereof can be made and that many changes can be made in the preferred embodiments without departing from the principals of the invention. Accordingly, it is to be distinctly understood that the foregoing descriptive matter is to be interpreted merely as illustrative of the invention and not as a limitation.

It is claimed:

1. A cable dispenser for dispensing a wire or cable from a spool of wire, the spool of wire having an inner core assembly with a spool core and end flanges that support the wire or cable about a spool axis, the core assembly further including a hub opening in a bottom end flange to allow the spool to be rotated about the spool axis and the hub opening having at least one hub opening edge, the bottom end flange further including a bottom surface; the cable dispenser comprising a base plate having a top and an opposite bottom, the base plate further including side edges extending between end edges, the base plate having at least one spool support station within the side and end edges to support an associated spool of wire such that an associated bottom surface of an associated bottom end flange of the associated spool of wire faces the top of the base plate and the spool axis of the associated wire spool is held in a generally vertical orientation, the spool support station including a vertically extending hub shaped to enter and at least partially align with an associated hub opening in the associated bottom end flange and the vertically extending hub being coaxial with a hub axis such that the hub axis is in general alignment with the associated spool axis when the hub is positioned in the associated hub opening, the spool support station further including a plurality of upwardly extending roller bearings, the plurality of roller bearings directly engaging the associated bottom flange surface and rolling along the associated bottom flange as the associated spool of wire rotates relative to the cable dispenser about the hub axis wherein the plurality of upwardly extending bearings providing rotatable support of the weight of the associated spool to allow rotation about the hub axis, the cable dispenser further including a motion device extending downwardly relative to the base plate bottom to allow selective movement of the dispenser relative to an associated underlying surface.

2. The cable dispenser of claim 1 wherein the plurality of upwardly extending bearings includes at least three roller bearings positioned about the hub axis, the at least three roller bearings directly engaging the associated bottom flange surface and fully supporting the weight of the associated spool of wire, the vertically extending hub shaped to enter and at least partially align with the associated hub opening in the associated bottom end flange being fixed relative to base plate wherein the hub opening rotates relative to the vertically extending hub.

3. The cable dispenser of claim 2 wherein the plurality of roller bearings is at least four roller ball bearings positioned about the hub axis.

4. The cable dispenser of claim 2 wherein the at least three roller bearings are ball bearings positioned about the hub axis and each ball bearing being a singular ball bearing extending upwardly from a top surface of the top of the base plate.

5. The cable dispenser of claim 1 wherein the at least one spool support station is a first spool support station and a second support station, the vertically extending hub being a first vertically extending hub associated with the first spool support station and being coaxial with a first hub axis, the plurality of upwardly extending s being a first set of upwardly extending bearings and the at least one alignment peg being a first peg set, the second support station having a second vertically extending hub that is coaxial with a second hub axis, the second hub axis being spaced from the first hub axis along the plate top, the second support station being configured to support a second associated spool, the second support station including a second set of upwardly extending bearings and a second peg set, the first and second support stations supporting the first and second associated spools adjacent to one another above the plate top wherein the first and second spool axes are generally parallel to one another but spaced from one another.

6. The cable dispenser of claim 5 wherein the first peg set is a first peg and the second peg set is a second peg, the first peg having a first peg side edge and the second peg having a second peg side edge, the first and second peg side edges being generally equidistant to both the first and second hub axes.

7. The cable dispenser of claim 5 wherein the first set of bearings includes at least three roller bearings positioned about the first hub axis wherein the at least three roller bearings each directly engage the first associated bottom flange surface and fully supporting the weight of the first associated spool of wire; the second set of bearings includes at least three roller bearings positioned about the second hub axis wherein the at least three roller bearings each directly engage the second associated bottom flange surface and fully supporting the weight of the second associated spool of wire.

8. The cable dispenser of claim 7 wherein the first and second set of roller bearings each includes at least four roller bearing ball bearings positioned about the respective hub axes.

9. The cable dispenser of claim 7 wherein the at least three roller bearings are ball bearings positioned about the respective hub axes and each ball bearing is a singular ball bearing extending upwardly from a top surface of the base plate top and directly engaging the respective associated bottom flange surface.

10. The cable dispenser of claim 1 wherein the motion device includes a plurality of casters extending downwardly from the base plate bottom surface to allow for the selective movement.

11. The cable dispenser of claim 10 wherein the plurality of casters includes at least one locking caster.

12. A cable dispenser for dispensing a wire or cable from a spool of wire, the spool of wire having an inner core assembly with a spool core and end flanges that support the wire or cable about a spool axis, the core assembly further including a hub opening in a bottom end flange to allow the spool to be rotated about the spool axis and the hub opening having at least one hub opening edge, the bottom end flange further including a bottom surface; the cable dispenser comprising a base plate having a top and an opposite bottom, the base plate further including side edges extending between end edges, the base plate having at least one spool support station within the side and end edges to support an associated spool of wire such that an associated bottom surface of an associated bottom end flange faces the top of the base plate and the spool axis of the associated wire spool is held in a generally vertical orientation, the spool support station including a vertically extending hub shaped to enter and at least partially align with an associated hub opening in the associated bottom end flange and the vertically extending hub being coaxial with a hub axis such that the hub axis is in general alignment with the associated spool axis when the hub is positioned in the associated hub opening, the spool support station further including at least one upwardly extending bearing positioned to engage the associated bottom flange surface, and the at least one upwardly extending bearing providing rotatable support of the weight of the associated spool to allow rotation about the hub axis, the cable dispenser further including a motion device extending downwardly relative to the base plate bottom to allow selective movement of the dispenser relative to an associated underlying surface, the cable dispenser further including at least one alignment peg, the at least one alignment peg having a peg edge spaced from the hub axis a distance generally equal to a flange radius of the associated bottom end flange.

13. The cable dispenser of claim 12 wherein the at least one alignment peg includes two alignment pegs each have peg edges that are generally equidistant from the hub axis and circumferentially spaced about the hub axis.

14. The cable dispenser of claim 12 wherein the peg edge is a cylindrical peg edge.

15. A cable dispenser for dispensing a wire or cable from a spool of wire, the spool of wire having an inner core assembly with a spool core and end flanges that support the wire or cable about a spool axis, the core assembly further including a hub opening in a bottom end flange to allow the spool to be rotated about the spool axis and the hub opening having at least one hub opening edge, the bottom end flange further including a bottom surface; the cable dispenser comprising a base plate having a top and an opposite bottom, the base plate further including side edges extending between end edges, the base plate having at least one spool support station within the side and end edges to support an associated spool of wire such that an associated bottom surface of an associated bottom end flange faces the top of the base plate and the spool axis of the associated wire spool is held in a generally vertical orientation, the spool support station including a vertically extending hub shaped to enter and at least partially align with an associated hub opening in the associated bottom end flange and the vertically extending hub being coaxial with a hub axis such that the hub axis is in general alignment with the associated spool axis when the hub is positioned in the associated hub opening, the spool support station further including at least one upwardly extending bearing positioned to engage the associated bottom flange surface, and the at least one upwardly extending bearing providing rotatable support of the weight of the associated spool to allow rotation about the hub axis, the cable dispenser further including a motion device extending downwardly relative to the base plate bottom to allow selective movement of the dispenser relative to an associated underlying surface, the at least one spool support station is a first spool support station and a second support station, the vertically extending hub being a first vertically extending hub associated with the first spool support station and being coaxial with a first hub axis, the at least one upwardly extending bearing being a first bearing assembly and the at least one alignment peg being a first peg set, the second support station having a second vertically extending hub that is coaxial with a second hub axis, the second hub axis being spaced from the first hub axis along the plate top, the second support station being configured to support a second associated spool, the second support station including a second bearing assembly and a second peg set, the first and second support stations supporting the first and second associated spools adjacent to one another above the plate top wherein the first and second spool axes are generally parallel to one another but spaced from one another, the first peg set includes a first peg and the second peg set includes a second peg, the first peg having a first peg side edge spaced from the first hub axis a distance generally equal to a radius of an associated first bottom end flange of the first associated spool and the second peg having a second peg side edge spaced from the second hub axis a distance generally equal to a radius of a second associated bottom end flange of the second associated spool.

16. A cable dispenser for dispensing a wire or cable from a spool of wire, the spool of wire having an inner core assembly with a spool core and end flanges that support the wire or cable about a spool axis, the core assembly further including a hub opening in a bottom end flange to allow the spool to be rotated about the spool axis and the hub opening having at least one hub opening edge, the bottom end flange further including a bottom surface; the cable dispenser comprising a base plate having a top and an opposite bottom, the base plate top having a first spool support station positioned about a first station axis and a second spool support station positioned about a second station axis, the first and second station axes being radially spaced from one another on the base plate top, spaced along the top surface, the first support station configured to support a first associated spool of wire and the second support station configured to support a second associated spool of wire, the first support station having a first vertically extending hub shaped to enter and at least partially align with an associated first hub opening in the associated first bottom end flange of the associated first spool of wire and the first vertically extending hub being coaxial with a first hub axis such that the first hub axis is in general alignment with the first associated spool axis when the hub is positioned in the associated hub opening, the first spool support station further including a first plurality of upwardly extending roller bearings, the first plurality of upwardly extending roller bearings directly engaging the first associated bottom flange surface and rolling along the first associated bottom flange surface as the first associated spool of wire rotates relative to the cable dispenser about the first hub axis wherein the first plurality of upwardly extending roller bearings provides rotatable support of the weight of the first associated spool to allow rotation about the first hub axis, the first support station further including a first alignment means for aligning the first hub and the associated first hub opening; the second support station having a second vertically extending hub shaped to enter and at least partially align with an associated second hub opening in the associated second bottom end flange of the associated second spool of wire and the second vertically extending hub being coaxial with a second hub axis such that the second hub axis is in general alignment with the second associated spool axis when the hub is positioned in the associated hub opening, the second spool support station further including a second plurality of upwardly extending roller bearings, the second plurality of upwardly extending roller bearings directly engaging the second associated bottom flange surface and rolling along the second associated bottom flange surface as the second associated spool of wire rotates relative to the cable dispenser about the second hub axis wherein the second plurality of upwardly extending roller bearings provides rotatable support of the weight of the second associated spool to allow rotation about the second hub axis, the second support station further including a second alignment means for aligning the second hub and the associated second hub opening; the cable dispenser further including a motion device extending downwardly relative to the base plate bottom surface to allow selective movement of the dispenser relative to an associated underlying surface.

17. The cable dispenser of claim 16 wherein the first and second plurality of upwardly extending roller bearings include at least three roller bearings positioned about the respective hub axis, the at least three roller bearings each directly engaging the respective associated bottom flange surface and fully supporting the weight of the respective associated spools of wire.

18. The cable dispenser of claim 16 wherein the plurality of roller bearings are ball bearings positioned about the respective hub axis and each ball bearing being a singular ball bearing extending upwardly from a top surface of the top of the base plate and each directly engaging the respective associated bottom flange surface, the first and second vertically extending hubs shaped to enter and at least partially align with the associated hub opening in the corresponding associated bottom end flange being fixed relative to base plate wherein the hub openings rotate relative to the first and second vertically extending hubs.

19. The cable dispenser of claim 16 wherein the first alignment means includes a first peg and the second alignment means includes a second peg, the first peg having a first peg side edge and the second peg having a second peg side edge, the first and second peg side edges being generally equidistant to both the first and second hub axes.

20. A cable dispenser for dispensing a wire or cable from a spool of wire, the spool of wire having an inner core assembly with a spool core and end flanges that support the wire or cable about a spool axis, the core assembly further including a hub opening in a bottom end flange to allow the spool to be rotated about the spool axis and the hub opening having at least one hub opening edge, the bottom end flange further including a bottom surface; the cable dispenser comprising a base plate having a top and an opposite bottom, the base plate top having a first spool support station positioned about a first station axis and a second spool support station positioned about a second station axis, the first and second station axes being radially spaced from one another on the base plate top, spaced along the top surface, the first support station configured to support a first associated spool of wire and the second support station configured to support a second associated spool of wire, the first support station having a first vertically extending hub shaped to enter and at least partially align with an associated first hub opening in the associated first bottom end flange and the first vertically extending hub being coaxial with a first hub axis such that the first hub axis is in general alignment with the first associated spool axis when the hub is positioned in the associated hub opening, the first spool support station further including a first bearing assembly configured to engage the first associated bottom flange surface the first bearing assembly providing rotatable support of the weight of the first associated spool to allow rotation about the first hub axis, the first support station further including a first alignment means for aligning the first hub and the associated first hub opening; the second support station having a second vertically extending hub shaped to enter and at least partially align with an associated second hub opening in the associated second bottom end flange and the second vertically extending hub being coaxial with a second hub axis such that the second hub axis is in general alignment with the second associated spool axis when the hub is positioned in the associated hub opening, the second spool support station further including a second bearing assembly configured to engage the second associated bottom flange surface the second bearing assembly providing rotatable support of the weight of the second associated spool to allow rotation about the second hub axis, the second support station further including a second alignment means for aligning the second hub and the associated second hub opening; the cable dispenser further including a motion device extending downwardly relative to the base plate bottom surface to allow selective movement of the dispenser relative to an associated underlying surface, the first and second alignment means include at least one alignment peg having a peg side edge spaced from the hub axes a distance generally equal to a flange radius of the associated bottom end flange.

21. A cable dispenser for dispensing a wire or cable from a spool of wire, the spool of wire having an inner core assembly with a spool core and end flanges that support the wire or cable about a spool axis, the core assembly further including a hub opening in a bottom end flange to allow the spool to be rotated about the spool axis and the hub opening having at least one hub opening edge, the bottom end flange further including a bottom surface; the cable dispenser comprising a base plate having a top and an opposite bottom, the base plate top having a first spool support station positioned about a first station axis and a second spool support station positioned about a second station axis, the first and second station axes being radially spaced from one another on the base plate top, spaced along the top surface, the first support station configured to support a first associated spool of wire and the second support station configured to support a second associated spool of wire, the first support station having a first vertically extending hub shaped to enter and at least partially align with an associated first hub opening in the associated first bottom end flange and the first vertically extending hub being coaxial with a first hub axis such that the first hub axis is in general alignment with the first associated spool axis when the hub is positioned in the associated hub opening, the first spool support station further including a first bearing assembly configured to engage the first associated bottom flange surface the first bearing assembly providing rotatable support of the weight of the first associated spool to allow rotation about the first hub axis, the first support station further including a first alignment means for aligning the first hub and the associated first hub opening; the second support station having a second vertically extending hub shaped to enter and at least partially align with an associated second hub opening in the associated second bottom end flange and the second vertically extending hub being coaxial with a second hub axis such that the second hub axis is in general alignment with the second associated spool axis when the hub is positioned in the associated hub opening, the second spool support station further including a second bearing assembly configured to engage the second associated bottom flange surface the second bearing assembly providing rotatable support of the weight of the second associated spool to allow rotation about the second hub axis, the second support station further including a second alignment means for aligning the second hub and the associated second hub opening; the cable dispenser further including a motion device extending downwardly relative to the base plate bottom surface to allow selective movement of the dispenser relative to an associated underlying surface, the first alignment means includes a first peg and the second peg set includes a second peg, the first peg having a first peg side edge spaced from the first hub axis a distance generally equal to a radius of an associated first bottom end flange of the first associated spool and the second peg having a second peg side edge spaced from the second hub axis a distance generally equal to a radius of a second associated bottom end flange of the second associated spool.

* * * * *